US010538997B2

(12) United States Patent
Bird

(10) Patent No.: US 10,538,997 B2
(45) Date of Patent: Jan. 21, 2020

(54) EXTENDED JET PERFORATING DEVICE

(71) Applicant: Halliburton Energy Services, Inc., Houston, TX (US)

(72) Inventor: Dean Vernell Bird, Kenai, AK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/729,118

(22) Filed: Oct. 10, 2017

(65) Prior Publication Data

US 2018/0045025 A1 Feb. 15, 2018

Related U.S. Application Data

(62) Division of application No. 13/985,046, filed as application No. PCT/US2012/056162 on Sep. 19, 2012, now Pat. No. 9,822,617.

(51) Int. Cl.

| | |
|---|---|
| ***E21B 43/1185*** | (2006.01) |
| ***E21B 43/116*** | (2006.01) |
| ***E21B 43/117*** | (2006.01) |
| ***F42B 1/028*** | (2006.01) |
| ***F42B 3/08*** | (2006.01) |

(52) U.S. Cl.
CPC ..... *E21B 43/1185* (2013.01); *E21B 43/116* (2013.01); *E21B 43/117* (2013.01); *F42B 1/028* (2013.01); *F42B 3/08* (2013.01)

(58) Field of Classification Search
CPC ... E21B 43/1185; E21B 43/116; E21B 43/117
USPC ..... 89/1.15, 1.151
See application file for complete search history.

(56) References Cited

U.S. PATENT DOCUMENTS

| | | | | |
|---|---|---|---|---|
| 2,782,715 | A * | 2/1957 | Udry | E21B 43/117 102/306 |
| 2,809,585 | A | 10/1957 | Moses | |
| 2,972,948 | A | 2/1961 | Kray | |
| 3,013,491 | A * | 12/1961 | Poulter | E21B 43/117 102/309 |
| 4,259,906 | A | 4/1981 | Krauch, Jr. et al. | |
| 4,794,990 | A * | 1/1989 | Riggs | E21B 41/02 102/306 |
| 4,829,901 | A | 5/1989 | Yates, Jr. | |
| 4,860,654 | A | 8/1989 | Chawla | |
| 4,942,819 | A | 7/1990 | Thoma et al. | |
| 5,005,641 | A * | 4/1991 | Mohaupt | E21B 43/263 102/313 |
| 5,633,475 | A | 5/1997 | Chawla | |
| 5,792,977 | A | 8/1998 | Chawla | |
| 5,847,312 | A | 12/1998 | Walters | |
| 6,186,070 | B1 | 2/2001 | Fong et al. | |
| 6,687,726 | B1 | 2/2004 | Schneider | |
| 6,786,157 | B1 | 9/2004 | Powell | |
| 6,899,032 | B2 | 5/2005 | Ronn et al. | |
| 8,381,652 | B2 | 2/2013 | Glenn | |

(Continued)

*Primary Examiner* — Stephen Johnson
(74) *Attorney, Agent, or Firm* — Chamberlain Hrdlicka

(57) ABSTRACT

An explosive charge assembly comprises a casing, a first liner, a second liner, a first explosive charge disposed between the casing and the first liner, and a second explosive charge disposed between the first liner and the second liner. The first liner and the second liner are configured to form a single jet upon detonation of the first explosive charge and the second explosive charge.

8 Claims, 6 Drawing Sheets

(56) References Cited

U.S. PATENT DOCUMENTS

| | | | | |
|---|---|---|---|---|
| 8,443,731 | B1 * | 5/2013 | Stecher | F42B 1/032 102/476 |
| 9,169,695 | B1 | 10/2015 | Calvert | |
| 2002/0178962 | A1 | 12/2002 | Reese et al. | |
| 2002/0189482 | A1 * | 12/2002 | Kneisl | C06B 45/10 102/306 |
| 2008/0282924 | A1 | 11/2008 | Saenger et al. | |
| 2009/0050321 | A1 | 2/2009 | Rhodes et al. | |
| 2009/0235836 | A1 | 9/2009 | Pratt et al. | |
| 2011/0219978 | A1 | 9/2011 | Glenn | |
| 2013/0061771 | A1 * | 3/2013 | Betancourt | E21B 43/117 102/307 |

* cited by examiner

EXTENDED JET PERFORATING DEVICE

This application is a divisional application of and claims priority to U.S. Application No. 13/985,046 which is a 35 U.S.C. 371 National Stage of and claims priority to International Application No. PCT/US12/56162, filed Sep. 19, 2012, entitled "EXTENDED JET PERFORATING DEVICE," which is incorporated herein by reference in its entirety for all purposes.

BACKGROUND

Wellbores are drilled through subterranean formations to allow hydrocarbons to be produced. In a typical completion, casing is set within the wellbore and retained in place using cement pumped into the annular region between the casing and the wellbore wall. In order to provide fluid communication through the casing and cement for production of hydrocarbons or other fluids, one or more fluid communication passages called perforations may be formed through the casing and cement using a perforating charge in a perforating procedure.

Perforating generally involves disposing a perforating gun at a desired location in a wellbore and firing a perforating gun containing perforating charges to provide the fluid communication through the casing. The fluid communication pathways generally extend through the casing and cement and into the formation. Fluid can then flow through the perforations, cement, and casing into the interior of the wellbore for production to the surface of the wellbore.

SUMMARY

In an embodiment, an explosive charge assembly comprises a casing, a first liner, a second liner, a first explosive charge disposed between the casing and the first liner, and a second explosive charge disposed between the first liner and the second liner. The first liner and the second liner are configured to form a single jet upon detonation of the first explosive charge and the second explosive charge.

In an embodiment, a perforating gun assembly comprises a gun body, and one or more explosive charge assemblies disposed in the gun body. At least one of the one or more explosive charge assemblies comprises a casing, a plurality of liners disposed within the casing, and a plurality of explosive charge layers. A first of the explosive charge layers is disposed between the casing and a first liner of the plurality of liners, and at least one explosive charge layer of the plurality of explosive charge layers is disposed between adjacent liners of the plurality of liners.

In an embodiment, a method of perforating comprises detonating an explosive charge assembly, where the explosive charge assembly comprises a plurality of liners, forming a jet in response to the detonating, where the each of the plurality of liners contribute to the formation of the jet, engaging a surface with the jet, and forming a perforation through the surface in response to the engagement with the jet.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
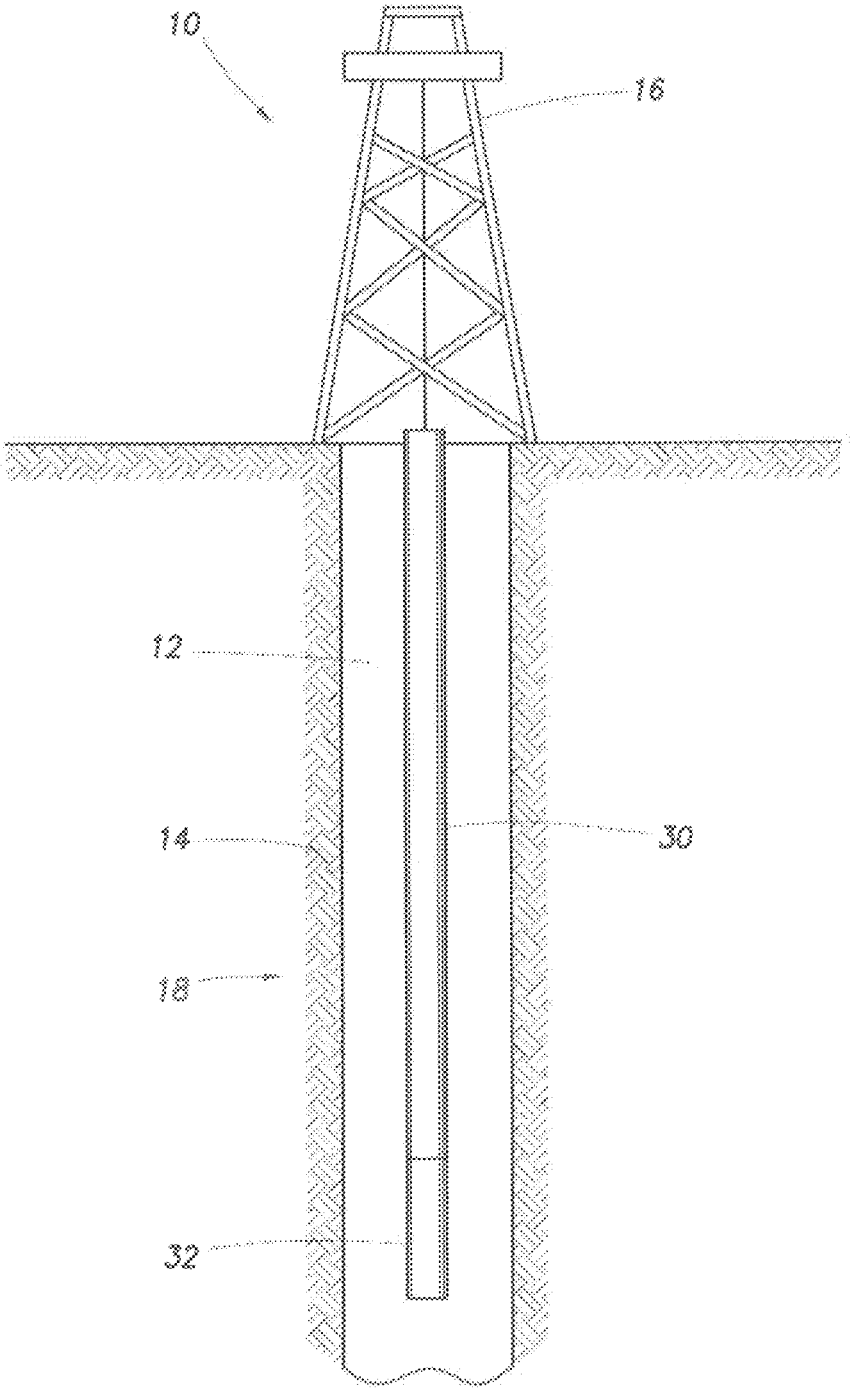
FIG. 1 is a cut-away view of an embodiment of a wellbore servicing system according to an embodiment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," or "upward," meaning toward the surface of the wellbore and with "down," "lower," or "downward," meaning toward the terminal end of the well, regardless of the wellbore orientation. Reference to in or out will be made for purposes of description with "in," "inner," or "inward" meaning toward the center or central axis of the wellbore, and with "out," "outer," or "outward" meaning toward the wellbore tubular and/or wall of the wellbore. Reference to "longitudinal," "longitudinally," or "axially" means a direction substantially aligned with the main axis of the wellbore and/or wellbore tubular. Reference to "radial" or "radially" means a direction substantially aligned with a line between the main axis of the wellbore and/or wellbore tubular and the wellbore wall that is substantially normal to the main axis of the wellbore and/or wellbore tubular, though the radial direction does not have to pass through the central axis of the wellbore and/or wellbore tubular. The various characteristics mentioned above, as well as other features and characteristics described in more detail below, will be readily apparent to those skilled in the art with the aid of this disclosure upon reading the following detailed description of the embodiments, and by referring to the accompanying drawings.

During the firing of the perforation charge, the liner may collapse and develop into a high speed jet to create the perforation tunnel in the subterranean formation. In a typical perforating procedure, the depth to which the perforating charge extends into the formation can be based on a variety of factors such as the size of the perforating charges, the amount of explosives, and/or the amount and type of liner used. These variables can be adjusted to provide for a deeper penetration at the cost of the diameter of the resulting perforation tunnel. In other words, the resulting jet can be shaped to form a long narrow jet, or a shorter, wider jet. The depth of the tunnel may thus be limited by the amount of liner material available to form the jet during the perforating event.

As described in more detail herein, the jet may be capable of forming a deeper perforation tunnel if the length of the jet could be extended without having to change the diameter of the resulting jet. One solution is to provide additional liner material to feed the formation of the jet. However, simply adding additional material to a jet may affect the overall size of the perforating charge and/or result in a denser jet without affecting the length of the jet. As described herein, additional material used to feed the jet may be provided using a plurality of liners. The resulting perforating charge may have a plurality of liners, each separated by a layer of explosive material. The perforating charge may be capable of forming a single jet having an extended length relative to a perforating charge having a single liner. Further, the shape of each of the liners may be varied to produce a jet with the desired penetrating properties. Thus, the perforating charges as described herein may be capable of forming deeper perforating tunnels into the subterranean formation without sacrificing the perforating tunnel diameter.

As illustrated in FIG. 1, a wellbore servicing system 10 comprises a servicing rig 16 that extends over and around a wellbore 12 that penetrates a subterranean formation 14. The wellbore 12 may be used to recover hydrocarbons, store hydrocarbons, dispose of various fluids (e.g., recovered water, carbon dioxide, etc.), recover water (e.g., potable water), recover geothermal energy, or the like. The wellbore 12 may be drilled into the subterranean formation 14 using any suitable drilling technique. While shown as extending vertically from the surface in FIG. 1, in some embodiments the wellbore 12 may be horizontal, deviated at any suitable angle, and/or curved over one or more portions of the wellbore 12. The wellbore 12 generally comprises an opening disposed in the earth having a variety of shapes and/or geometries, and the wellbore 12 may be cased, open hole, and/or lined.

The servicing rig 16 may be one of a drilling rig, a completion rig, a workover rig, a servicing rig, or other mast like structure and may support a wellbore tubular string 18 in the wellbore 12. In some embodiments, a different structure may support the wellbore tubular string 18, for example an injector head of a coiled tubing rig. In an embodiment, the servicing rig 16 may comprise a derrick with a rig floor through which the wellbore tubular string 18 extends downward from the servicing rig 16 into the wellbore 12. In some embodiments, such as in an off-shore location, the servicing rig 16 may be supported by piers extending downwards to a seabed. In some embodiments, the servicing rig 16 may be supported by columns sitting on hulls and/or pontoons that are ballasted below the water surface, which may be referred to as a semi-submersible platform or rig. In an off-shore location, a casing may extend from the servicing rig 16 to exclude seawater. It should be understood that other conveyance mechanisms may control the run-in and withdrawal of the wellbore tubular string 18 in the wellbore 12, for example draw works coupled to a hoisting apparatus, a slickline unit, a wireline unit (e.g., including a winching apparatus), another servicing vehicle, a coiled tubing unit, and/or any other suitable apparatus.

In an embodiment, the wellbore tubular string 18 may comprise any of a variety of wellbore tubulars 30, a perforation tool 32, and optionally, other tools and/or subassemblies located above and/or below the perforation tool 32. The wellbore tubulars 30 may include, but are not limited to, jointed pipes, coiled tubing, any other suitable tubulars, or any combination thereof. In some embodiments, various conveyance mechanisms such as slicklines, wirelines, or other conveyances may be used in place of the wellbore tubulars 30. In an embodiment, the perforation tool 32 comprises one or more explosive charges that may be triggered to explode, perforating a casing, if present, a wall of the wellbore 12, and/or forming perforation tunnels in the subterranean formation 14. The perforating may allow for the recovery of fluids such as hydrocarbons from the subterranean formation 14 for production at the surface, storing fluids (e.g., hydrocarbons, aqueous fluids, etc.) flowed into the subterranean formation 14, and/or disposed on various fluids in the subterranean formation 14.

Figure 2:
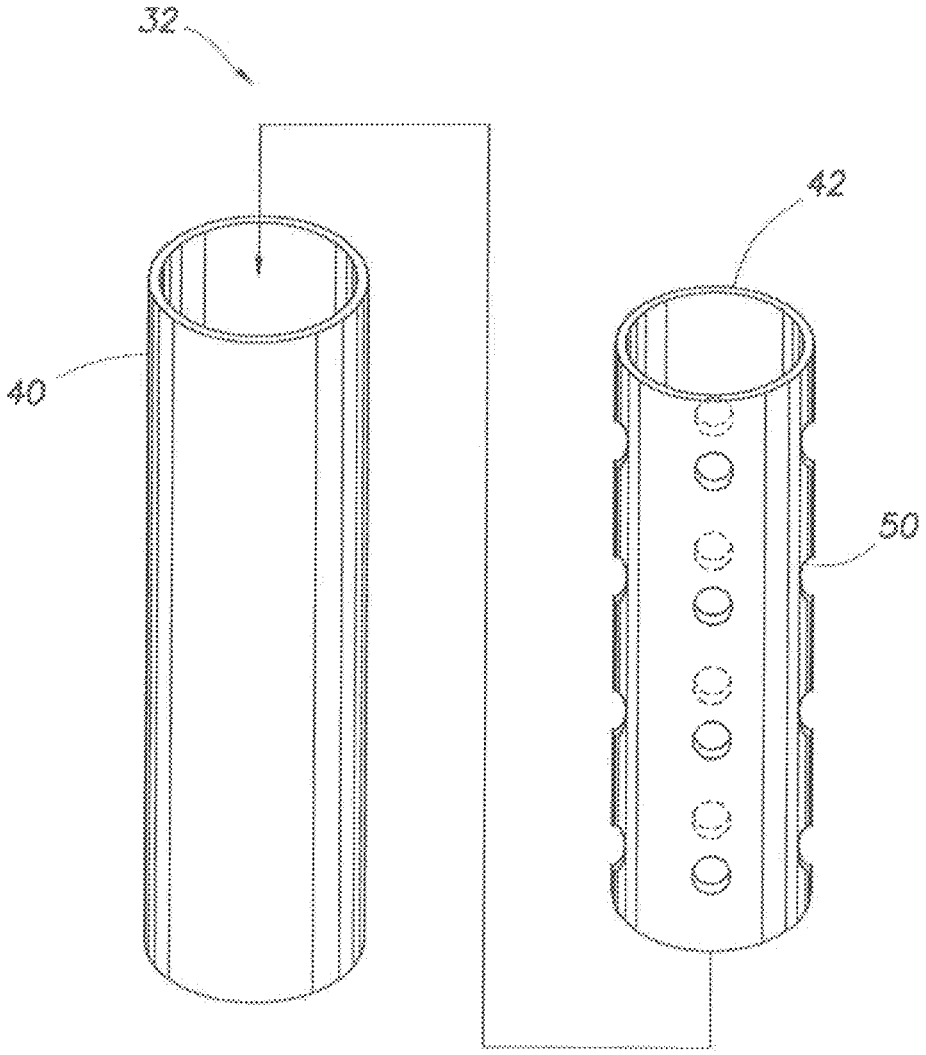
FIG. 2 is a schematic view of an embodiment of a perforating tool.

As illustrated in FIG. 2, the perforation tool 32 comprises a gun body 40, a charge carrier frame 42, and one or more explosive charge assemblies 50. The gun body 40 contains one or more charge carrier frames 42 and the explosive charge assemblies 50, and the gun body 40 is configured to protect and seal the components from the downhole environment prior to perforation. A surface of the gun body 40 may be bored and/or countersunk proximate to the explosive charge assemblies 50 to promote ease of perforation of the gun body 40 by detonation of the explosive charge assemblies 50. The bore and/or countersunk surface may be referred to as a scalloping or scallops. The gun body 40 may comprise structures to couple the perforation tool 32 to the wellbore tubular string 30, other conveyance mechanisms, and/or other tools above and/or below the perforation tool 32. In an embodiment, the gun body 40 may comprise threads for engaging corresponding threads on adjacent components. The gun body 40 may be formed from any suitable material such as steel (e.g., carbon steel, stainless steel, chromium steel, or the like). In some embodiments, the gun body 40 may comprise various non-steel metals or metal alloys, and/or non-metallic components (e.g., composites, polymers, etc.). Similarly, the charge carrier frame 42 may be constructed out of various metals (e.g., steel, aluminum, various metals and/or alloys) and/or non-metallic (e.g., composites, polymers, etc.) components.

The explosive charge assemblies 50 may be disposed in a first plane perpendicular to the axis of the gun body 40, and additional planes or rows of additional explosive charge assemblies 50 may be positioned above and/or below the first plane. In an embodiment, four explosive charge assemblies 50 may be located in the same plane perpendicular to the axis of the gun body 40 about ninety degrees apart. In an embodiment, three explosive charge assemblies 50 may be located in the same plane perpendicular to the axis of the gun body 40 about one hundred twenty degrees apart. In some embodiments, more explosive charge assemblies may be located in the same plane perpendicular to the axis of the gun body 40. The direction of the explosive charge assemblies 50 may be offset by about forty five degrees between the first plane and a second plane to promote more densely arranging the explosive charge assemblies 50 within the gun body 40. The direction of the explosive charge assemblies 50 may be offset by about sixty degrees between a first plane and a second plane to promote more densely arranging the explosive charge assemblies 50 within the gun body 40.

In an embodiment, the charge carrier frame 42 retains the explosive charge assemblies 50 in place, oriented in a preferred direction, and with appropriate angular relationships between rows, and is disposed within the gun body 40. In an embodiment, a detonator cord can be coupled to each of the explosive charge assemblies 50 to pass along the detonation and detonate the explosive charge assemblies 50. When the perforation tool 32 comprises multiple planes and/or rows of explosive charge assemblies, the detonator cord may be disposed on the center axis of the gun body 40 while engaging each of the explosive charge assemblies 50. The detonator cord may be coupled to a detonator apparatus directly or through one or more booster assemblies. The detonator apparatus may be triggered by a variety of input signals such as electrical signals, mechanical impulses, pressure signals, and the like to initiate a detonation. When the detonator activates, a detonation propagates to the detonation cord and through each of the explosive charge assemblies 50 to detonate each of the explosive charge assemblies 50 in rapid succession.

The explosive charge assembly 50 may generally comprise a plurality of liners disposed in a casing with a plurality of explosive charges disposed between the liners and the casing in a layered configuration, which may be referred to as a plurality of explosive charge layers. This configuration may serve to provide additional liner material during the detonation of the explosive charge, thereby providing a jet having an extended length relative to an explosive charge assembly having a single liner. The extended jet may be configured to provide a deeper penetration and/or wider diameter perforation tunnel in the subterranean formation, thereby increasing the available area for fluid flow into and/or out of the wellbore.

Figures 3, 4, 5:
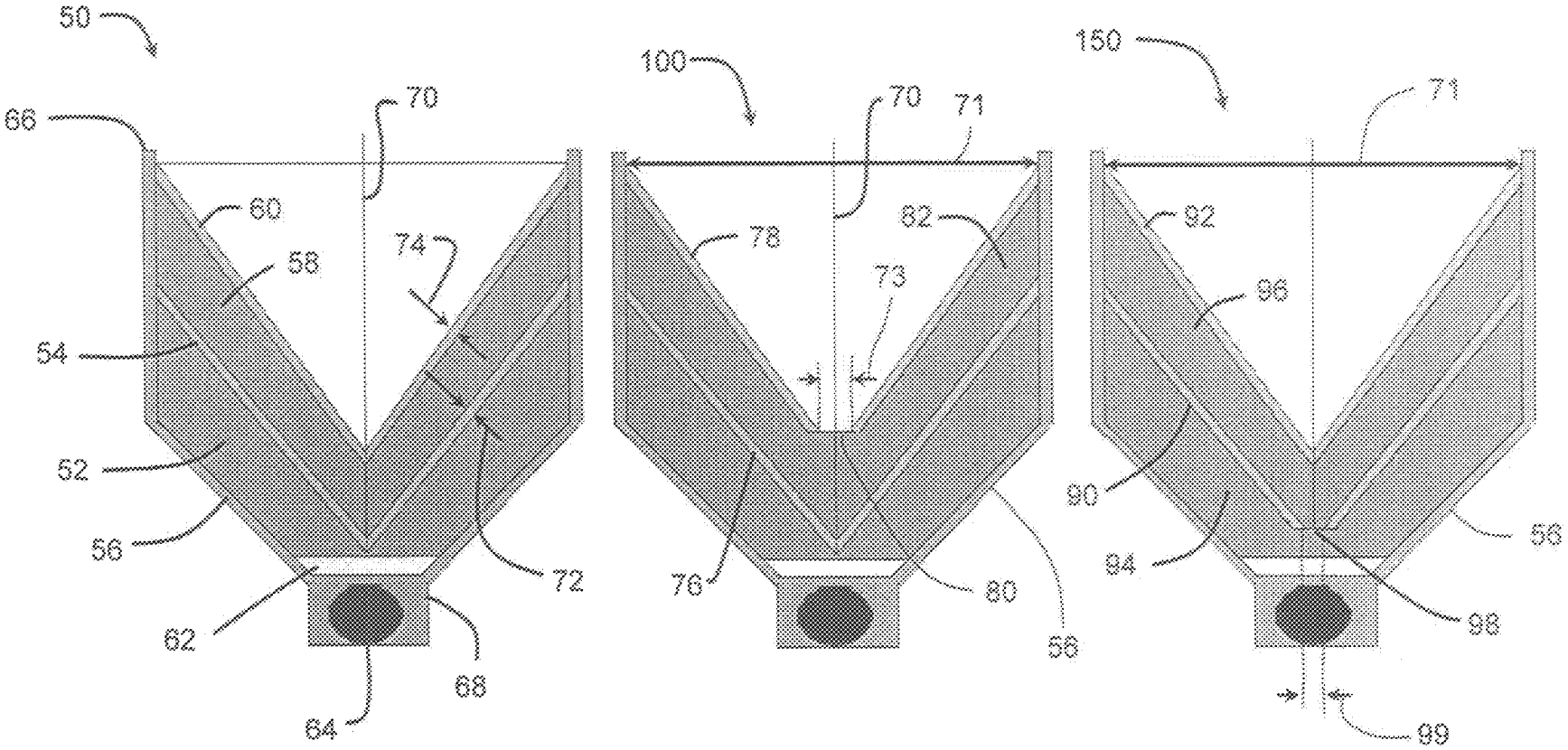
FIG. 3 illustrates a cross-sectional view of an embodiment of an explosive charge assembly.
FIG. 4 illustrates a cross-sectional view of another embodiment of an explosive charge assembly.
FIG. 5 illustrates a cross-sectional view of still another embodiment of an explosive charge assembly.

In the embodiment illustrated in FIG. 3, the explosive charge assembly 50 comprises a first explosive charge 52, a second explosive charge 58, a first liner 54, a second liner 60, and a casing 56. The casing 56 generally serves to hold the explosive charge(s) and liner(s) prior to detonation of the explosive charge assembly 50 while providing some degree of containment during the detonation to allow for the formation of the jet. In order to provide the shaped charge geometry, the casing 56 generally comprises a bowl like structure configured to retain the explosive charges and liners. In an embodiment, the casing as shown in FIG. 3 is a solid of revolution. A first end 66 of the casing 56 comprises an opening through which the jet may pass upon detonation of the explosive charge assembly 50, and a second end 68 of the casing 56 may be configured to receive and engage the detonator cord 64. The casing 56 may extend between the first end 66 and the second end 68 in a variety of shapes, and the wall thickness along the length may be substantially uniform, or in some embodiments, the wall thickness may vary along the length of the casing. While illustrated in FIG. 3 as having a cylindrical shaped portion, and a frusto-conical shaped portion, the casing 56 may comprise any variety of shapes including, but not limited to curved, elliptical, conical, cylindrical, or any combination thereof. The casing 56 can be formed from any suitable material such as a metal (e.g. steel, aluminum, tungsten, etc.), a composite material (e.g., reinforced polymers), a ceramic, or any combination thereof.

The explosive charge assembly 50 may be coupled to a detonator cord 64 at the second end 68 of the casing 56. A passageway may be formed in the second end 68 for receiving the detonator cord and retaining the detonator cord in a configuration for passing the explosive detonation from the detonator cord to one or more of the explosive charges 52, 58 within the casing 56. In some embodiments, a booster charge 62 may be disposed between the second end 68 of the casing 56 and the adjacent explosive charge 52. The booster charge 62 is generally configured to aid in transferring the explosive detonation from the detonator cord 64 to the explosive charge 52. The second end of the casing 68 may also comprise various coupling mechanisms to allow the explosive charge assembly 50 to be disposed and retained within the charge carrier. For example, the second end 68 of the casing 56 may comprise threads for engaging corresponding threads on the charge carrier. Various other coupling mechanisms such as indicators, latches, clips or the like may be used at any point along the casing 56 to allow the explosive charge assembly 50 to be coupled to the charge carrier and/or gun body.

The explosive charges 52, 58 may be disposed within the casing 56 in a layered configuration as illustrated in FIG. 3. As illustrated in FIG. 3, a plurality of explosive charges 52 may be disposed in a plurality of layers with a first explosive charge 52 disposed between the casing and first liner 54, and a second explosive charge 58 disposed between the first liner 54 and the adjacent second liner 60. One or more of the explosive charges 52, 58 may substantially fill the volume between the liner and casing and/or the adjacent pairs of liners. One or more of the liners may comprise a hole or passageway, thereby allowing the explosive charges 52, 58 to directly engage, as described in more detail herein. In some embodiments, one or more portions of the explosive charges may be left out, thereby forming a void. The layout of the charges, including any voids, may be used, at least in part, to alter the properties of the resulting jet formed from the detonation of the explosive charge assembly 50.

The explosive charges 52, 58 may comprise any suitable explosive useful with a shaped charge. In an embodiment, the explosive charge may comprise, lead azide, pentaerythritol tetranitrate (PETN), cyclotrimethylene trinitramine (RDX), hexanitrostilbene (HNS), cyclotetramethylene tetranitramine (HMX), bis(picrylamino) trinitropyridine (PYX), any other suitable explosives used with shaped charges, or any combination thereof. The explosive charge may generally be provided as a powdered or granular component that is pressed into the appropriate shape using a die or other suitable press for use with the explosive charge assembly 50.

In an embodiment, any plurality of liners and explosive charges may be used. In this embodiment, an explosive charge layer may be disposed between the casing 56 and the first liner 54, and a corresponding number of explosive charge layers may be disposed between each adjacent pair of liners. Each of the explosive charge layers can be the same or different. For example, each explosive charge layer can comprise the same explosive composition or a different explosive composition. The thickness of each explosive charge layer may be the same or different, and/or the shape of each layer may be the same or different. Various combinations of the explosive composition, the explosive charge layer thickness, and/or the explosive charge shape may be used to provide a shaped charge having the desired detonation and jet characteristics.

The liners 54, 60 may also be disposed within the casing 56 in a layered configuration as illustrated in FIG. 3. The liners 54, 60 may be configured to provide a stream of particles to form a jet upon detonation of the explosive charge assembly 50. The liners 54, 60 generally comprise a bowl like structure with the apex disposed closer to the second end 68 of the casing 56 than the divergent end, which may extend from the central axis 70 of the explosive charge assembly 50 towards the wall of the casing 56. In an embodiment, one or more of the liners 54, 60 may engage the inner surface of the casing 56 at its divergent end, which may be referred to in some contexts as the skirt portion. The liner may gradually widen as it extends along the central axis 70 from the apex to the skirt portion in any variety of shapes. As shown in FIG. 3, the liners 54, 60 may comprise conical shapes. In some embodiments, one or more of the plurality of liners 54, 60 may comprise other suitable shapes such as a frusto-conical shape, a curved shape, an elliptical shape, a partial round or oval shape, or any combination thereof and the shape may vary over the length of the liner. While not intending to be limited by theory, it is generally understood that conical or truncated conical shapes (e.g., frusto-conical shapes) having a sharp apex angle or narrow inside angle tend to form deeper penetrating jets. Liners having curved shapes (e.g., half-elliptical or oval shapes) or a large radius at the apex tend to form larger diameter jets for forming large perforation tunnels. Thus, the selection of the shape of one or more of the liners may be used, at least in part, to determine the characteristics and geometry of the resulting jet.

The liners 54, 60 may be formed from any suitable material. In general, the liners 54, 60 may be formed from a powdered material that is pressed into the desired shape using a die or press. In some embodiments, solid liners (e.g., stamped sheet metal liners) can also be used. When the liner is formed from a powdered or granular material, the material may comprise fine particles having a range of particle sizes. In an embodiment, the particles may range, in some embodiments, from about 8 microns to about 150 microns. The material may comprise various components such as various metals, binding agents, forming agents and the like. In an embodiment the material or materials used to form the liners 54, 60 may include, but is not limited to, tungsten, tantalum, lead, copper, graphite, gold, uranium (e.g., depleted uranium), or any combination thereof. The powdered materials may comprise combinations of reactive materials that react together in response to the detonation of the explosive charge assembly 50. For example, the powdered materials may comprise pairs of intermetallic reactants, pairs of thermite materials, or other reactive materials. Suitable reactive materials that may be used with the explosive charge assemblies described herein may include those described in U.S. Patent Publication No. 2011/0219978 filed Mar. 9, 2010, entitled "Shape Charge Liner Comprised of Reactive Materials," by Corbin S. Glenn, which is hereby incorporated by reference in its entirety. In some embodiments, the liner may comprise various components to assist in self-adhering of the powdered material particles, to lubricate the die set used to form the liners, and/or to reduce wear on the die set and/or other tools. For example, the liners may comprise various waxes, binders, lubricants, and anti-static agents to aid in forming the liners.

As illustrated in FIG. 3, a plurality of liners 54, 60 may be disposed in a plurality of layers. Each of the liners 54, 60 can be the same or different. For example, each liner 54, 60 can comprise the same composition or a different composition. The thickness 72, 74 of each liner may be the same or different, and/or the shape of each liner may be the same or different. Various combinations of the liner composition, the liner thickness, and/or the liner shape may be used to provide a shaped charge having the desired detonation and jet characteristics.

Various configurations of the liners 54, 60 and explosive charges 52, 58 are possible. As shown in FIG. 3, the liners 54, 60 comprise conical liners 54, 60 that are coaxially disposed within the casing 56, and the walls of the liners 54, 60 may be generally parallel. The first explosive charge 52 may substantially fill the area between the first liner 54 and the casing 56, and the second explosive charge 58 may substantially fill the area between the first liner 54 and the second liner 60. The liners 54, 60 may have similar thicknesses, which may be substantially uniform along their length from the apex to the skirt. While illustrated as being parallel and having a generally uniform thickness, other shapes of the liners are possible and the thickness of the liners may vary over their length.

FIG. 4 illustrates an explosive charge assembly 100 with a similar configuration to the explosive charge assembly 50 illustrated in FIG. 3. In this embodiment, the first liner 76 is disposed in a layered configuration with the second liner 78, and the second liner 78 comprises an aperture 80 at the apex of the second liner 78. The second liner 78 may then be described as having a frusto-conical shape. The aperture 80 may allow the explosive charge 82 to be exposed through the second liner 78. As described in more detail here, the jet generally begins to form at or near the apex of the liners 76, 78 along the central axis 70 of the explosive charge assembly. The use of the aperture 80 in the second liner 78 may then be used to alter the characteristics of the jet by removing a portion of the material that may form the leading end of the jet. The size of the aperture 80 may be selected to provide the desired jet properties (e.g., the jet density along the length of the jet). In an embodiment, the width 73 of the aperture 80 may extend at least about 5%, at least about 10%, at least about 15%, or at least about 20% of the diameter 71 of the inside surfaces of the casing 56.

FIG. 5 illustrates an explosive charge assembly 150 with a similar configuration to the explosive charge assembly 50 illustrated in FIG. 3. In this embodiment, the first liner 90 is disposed in a layered configuration with the second liner 92, and the first liner 90 comprises an aperture 98 at the apex of the first liner 90. The first liner 90 may then have a frusto-conical shape and the second liner 92 may have a conical shape. The first explosive charge 94 may contact the second explosive charge 96 at the aperture 98 in the first liner 90. This embodiment may provide a direct engagement between the explosive charges 94, 96. As described above, the use of the aperture 98 may result in a change in the properties of the resulting jet. In an embodiment, the use of the aperture 98 in the first liner 92 may be used to alter the characteristics of the jet by removing a portion of the material that may form a portion of the leading or central portion of the jet. The size of the aperture 80 may then be selected to provide the desired jet properties (e.g., the jet density along the length of the jet). In an embodiment, the width 99 of the aperture 98 may extend at least about 5%, at least about 10%, at least about 15%, or at least about 20% of the diameter 71 of the inside surfaces of the casing 56.

Figure 6:
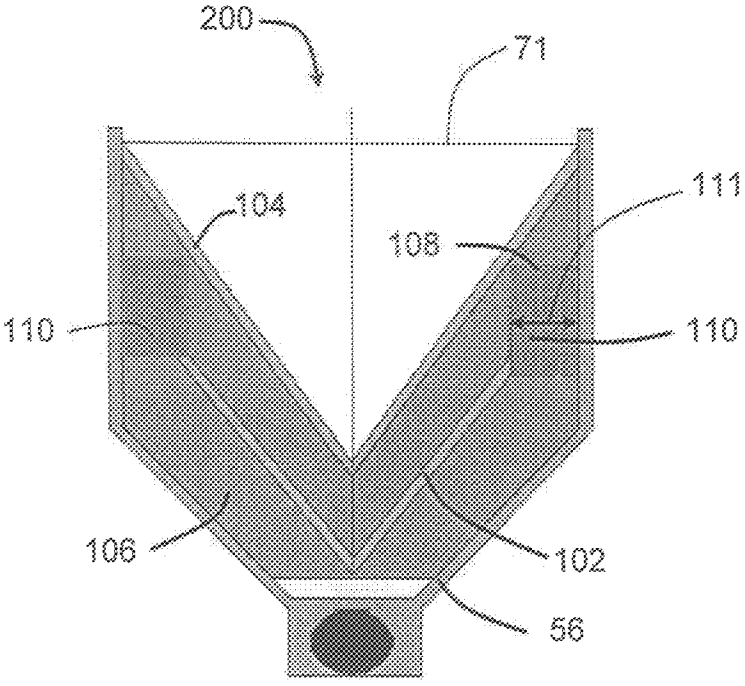
FIG. 6 illustrates a cross-sectional view of yet another embodiment of an explosive charge assembly.

FIG. 6 illustrates an explosive charge assembly 200 with a similar configuration to the explosive charge assembly 50 illustrated in FIG. 3. In this embodiment, the first liner 102 is disposed in a layered configuration with the second liner 104, and the first liner 102 comprises an opening 110 around the skirt of the first liner 102 such that the first liner 102 does not contact the casing 56. In some embodiments, the opening 110 may be provided along the length of the liner between the apex and skirt portions. The first explosive charge 106 may contact the second explosive charge 108 at the opening 110 in the first liner 102. This embodiment may provide a direct engagement between the explosive charges 106, 108. As described above, the use of the opening 110 to remove a portion of the liner material in the first liner 102 may result in a change in the properties of the resulting jet. In an embodiment, the use of the opening 110 in the first liner 102 may be used to alter the characteristics of the jet by removing a portion of the material that may form a portion of the trailing edge (e.g., the tail) of the jet. The size of the opening 110 may then be selected to provide the desired jet properties (e.g., the jet density along the length of the jet). In an embodiment, the width 111 of the opening 110 may extend at least about 2%, at least about 5%, at least about 10%, or at least about 15% of the diameter 71 of the inside surfaces of the casing 56. While the opening 110 is illustrated as being present in the first liner 102 in FIG. 6, the opening 110 may alternatively or additionally be provided in the second liner 104. In an embodiment comprising more than two liners, a central aperture in the apex of the liner and/or an opening in the skirt portion of the liners may be present on any number or combination of the liners. Further, an aperture and opening may be provided in any combination and can be present on the same liner.

Figures 7, 8, 9:
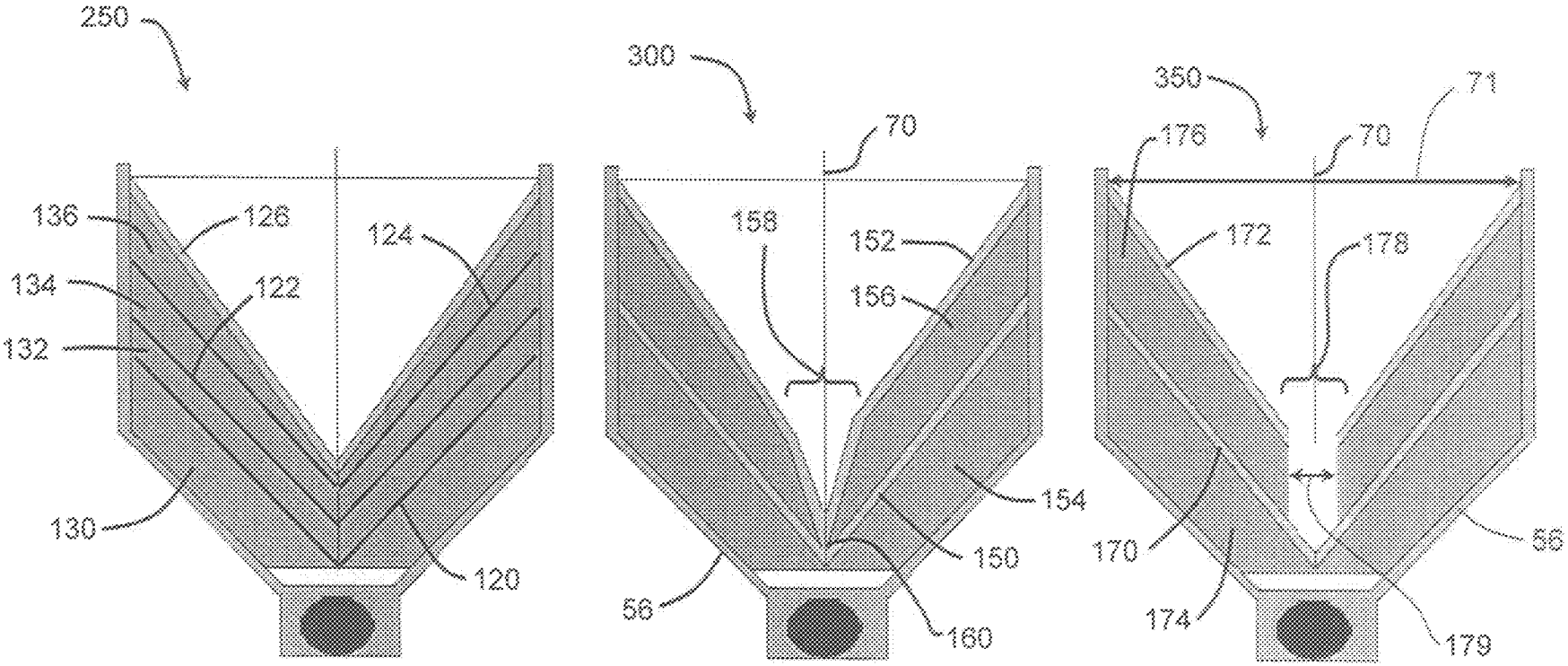
FIG. 7 illustrates a cross-sectional view of another embodiment of an explosive charge assembly.
FIG. 8 illustrates a cross-sectional view of still another embodiment of an explosive charge assembly.
FIG. 9 illustrates a cross-sectional view of yet another embodiment of an explosive charge assembly.

FIG. 7 illustrates an explosive charge assembly 250 with a similar configuration to the explosive charge assembly 50 illustrated in FIG. 3. In this embodiment, a plurality of liners 120, 122, 124, 126 are disposed in layered configuration with corresponding explosive charge layers 130, 132, 134, 136. While four liners and a corresponding number of explosive charges are illustrated in FIG. 7, it should be understood that any number of liners may be used. In an embodiment, the number of liners may range from about 2 to about 15, from about 2 to about 10, or from about 2 to about 5. The liners 120, 122, 124, 126 may all comprise the same configurations (e.g., approximately the same shape and thickness), or the configurations may be different between two or more of the liners. In some embodiments, the liners may comprise a graduated configuration. For example, the thickness and/or density of the liners may gradually increase or decrease from the first liner 120 to the fourth liner 126. In some embodiments, the thickness or density may vary along one or more of the liners 120, 122, 124, 126 between the apex portion and the skirt portion. Similarly, the properties (e.g., the thickness, composition, etc.) of the explosive charge layers 130, 132, 134, 136 may be the same or different. The variation of the liner and explosive charge properties may be used, at least in part, to provide a jet having the desired characteristics.

FIG. 8 illustrates an explosive charge assembly 300 with a similar configuration to the explosive charge assembly 50 illustrated in FIG. 3. In this embodiment, the first liner 150 is disposed in a layered configuration with the second liner 152. The second liner 152 may comprise an apex portion 158 extending towards the first liner 150. The apex portion 158 may engage the first liner 150 at a point 160, which may generally be aligned along the central axis 70. The first explosive charge 154 may be disposed between the first liner 150 and the casing 56. The second explosive charge 156 may be disposed between the first liner 150 and the second liner 152, where the apex portion may exclude a portion of the second explosive charge 156 along the central axis 70 of the explosive charge assembly 300. The apex portion 158 of the second liner 152 may comprise any number of shapes including, but not limited to, frusto-conical, curved, elliptical, partial round, partial oval, or any combination thereof. While illustrated as extending from the second liner 152 towards the first liner 150, the apex portion of the second liner 152 may also extend away from the first liner 150. In addition, the apex portion 158 may alternatively or additionally be used with the first liner 150 such that an apex portion of the first liner 150 extends towards or away from the second liner 152. The use of the apex portion 158 with the explosive charge assembly 300 may be configured to alter the characteristics of the jet (e.g., the jet density along the length of the jet).

FIG. 9 illustrates an explosive charge assembly 350 with a similar configuration to the explosive charge assembly 50 illustrated in FIG. 3 and the explosive charge assembly 100 illustrated in FIG. 4. In this embodiment, the first liner 170 is disposed in a layered configuration with the second liner 172, and the second liner 172 may comprise an aperture portion 178 disposed through the second liner 172 and/or the second explosive charge 176. A portion of the second explosive charge 176 may be left out at or near the apex portion 178 to form a void so that the second explosive charge 176 comprises a ring structure between the first liner 170 and the second liner 172. The void may be formed during the formation of the explosive charge assembly 350 by excluding material using a die and/or removing a portion of the second explosive charge 176 after the formation of the explosive charge assembly 350. The second liner 172 may then be described as having a frusto-conical shape. While illustrated as extending only through the second liner 172 and the second explosive charge 176, the void in the apex portion 178 can extend through one or more additional liners and/or explosive charge layers. For example, the void may extend through the first liner 170 and/or the first explosive charge 174. The use of the aperture in the second liner 172 and the void in the second explosive charge 176 may be used to alter the characteristics of the jet by removing a portion of the explosive charge responsible for the formation of the jet. The size of the aperture in the second liner and the void in the explosive charge 176 may be selected to provide the desired jet properties (e.g., the focus of the jet, the jet density along the length of the jet, etc.). In an embodiment, the width 179 of the void in the apex portion 178 may extend at least about 5%, at least about 10%, at least about 15%, or at least about 20% of the diameter 71 of the inside surfaces of the casing 56.

Figure 10:
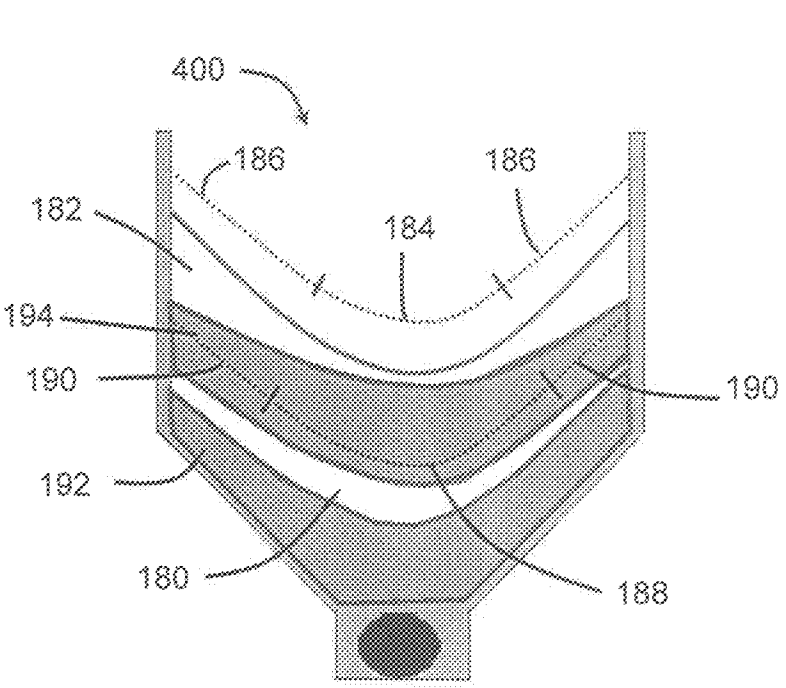
FIG. 10 illustrates a cross-sectional view of another embodiment of an explosive charge assembly.

FIG. 10 illustrates an explosive charge assembly 400 with a similar configuration to the explosive charge assembly 50 illustrated in FIG. 3. In this embodiment, the first liner 180 is disposed in a layered configuration with the second liner 182. The first liner 180 may comprise a half oval or half elliptical shape and the thickness of the first liner 180 may narrow from the apex portion 188 to the skirt portion 190. Similarly, the second liner 182 comprises a half oval or half elliptical shape and the thickness of the second liner 182 thickens from the apex portion 184 to the skirt portion 186. Further, the first liner 180 may have a greater radius of curvature than the second liner 182, resulting in the liners 180, 182 not having a parallel configuration. In some embodiments, the liners 180, 182 can have shapes having a parallel configuration. The resulting charge layers 192, 194 comprise shapes corresponding to the surfaces of the first liner 180 and the second liner 182.

While shown in various embodiments, the features of each of the embodiments illustrated herein can be used with any of the other embodiments illustrated herein. Further, a perforating gun assembly comprising a plurality of explosive charge assemblies may comprise any combination of the embodiments and/or features of the embodiments of the explosive charge assemblies described herein. Further, a perforating gun may comprise one or more explosive charge assemblies comprising a plurality of liners and one or more shaped charges comprising a single liner.

Figure 11:
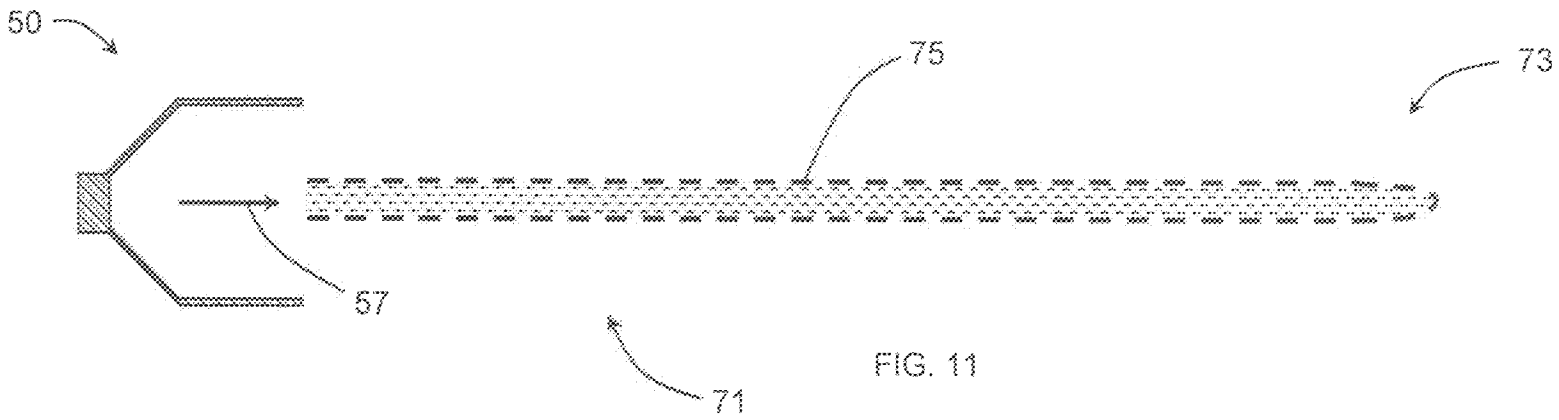
FIG. 11 schematically illustrates a jet formed by an embodiment of an explosive charge assembly.

As schematically illustrated in FIG. 11, the energy of a detonation of the explosive charge assembly 50, due for example to the propagation of a detonation from the detonator cord coupled to the explosive charge assembly 50, can be concentrated and/or focused along the explosive focus axis 57 to form the jet 75 indicated by the dotted line. A portion of the plurality of liners may be accelerated by the energy of the detonation and form the leading edge 73 of the jet 75, which may be followed by the trailing edge 71 of the jet 75 as the detonation continues and eventually ends. As the detonation continues, generally from the center of the explosive charge assembly 50 outwards, the plurality of liners feed the jet 75 as it is accelerated along the focused path 57. In an embodiment, each liner of the plurality of liners contributes to the formation of the jet 75. The resulting jet 75 generally comprises a coherent stream of particles that can penetrate the adjacent formation to form a perforation tunnel. A coherent jet is a jet that consists of a continuous stream of small particles. A non-coherent jet contains large particles or is a jet comprised of multiple streams of particles. In general, a jet stream that is coherent may have a greater penetration depth than the penetration depth of non-coherent jet streams.

Various factors can affect the formation of the jet 75 during the detonation of the explosive charge assembly 50. For example, the speed at which the liners are accelerated affects the degree to which the resulting jet forms a coherent jet, and a speed greater than a threshold (e.g., the speed of sound in the liners) may result in a non-coherent jet. Increasing the collapse speed of one or more of the liners may tend to increase the jet tip speed, which may be useful in providing improved penetrating potential. The choice of materials for forming the liners can affect the threshold speed for forming a coherent jet, and therefore the penetrating potential for the explosive charge assembly. In addition, the density and ductility of the liners can affect the explosive charge assembly performance. The density of the jet can be controlled by utilizing a dense liner material, selecting the spacing of the liners, and/or including voids, opening, and/or apertures in one or more of the liners. Jet length may be affected by the jet tip velocity and the jet velocity gradient. The jet velocity gradient is the rate at which the velocity of the jet changes along the length of the jet whereas the jet tip velocity is the velocity of the jet tip. The jet tip velocity and jet velocity gradient are controlled by the selection of the liner material and geometry, as described in more detail above. In general, it is expected that the jet length may increase with an increase in the jet tip velocity, an increase in the jet velocity gradient, and/or the number and spacing of the liners.

Returning to FIG. 3, a jet may be formed as an explosive charge assembly 50 is detonated. The detonation may be provided by a detonation traveling along a detonator cord 64, which may be initiated using a detonator assembly. The detonation may be conveyed through the detonator cord 64, to the booster charge 62 if present, and into the first explosive charge 52. The detonation may be conveyed to the second explosive charge 58 through the first liner 54. The detonation may generally proceed from the area adjacent the booster charge 62 outwards, resulting in the liner material near the apex portion forming the leading edge of the jet. As the detonation occurs, each of the plurality of liners 54, 60 may both feed the jet and contribute to the formation of a coherent jet.

The use of a plurality of liners 54, 60 may result in a jet having an increased length relative to an explosive charge assembly having only a single liner. In an embodiment, the length of the jet may be extended at least about 5%, at least about 10%, at least about 15%, at least about 20%, at least about 25%, at least about 30%, at least about 35%, or at least about 40% relative to a jet formed from an explosive charge assembly having a single liner. The resulting jet may engage a wellbore tubular wall (e.g., a casing wall, etc.), a cement layer, and/or a subterranean formation to form a perforation therethrough. For example, the jet may engage the subterranean formation to form a perforation tunnel therein. The jet having an increased length may provide an improved penetrating potential. In an embodiment, the resulting perforation tunnel in the subterranean formation may having an increased length of at least about 5%, at least about 10%, at least about 15%, at least about 20%, at least about 25%, at least about 30%, at least about 35%, or at least about 40% relative to a perforation tunnel formed by a jet formed from an explosive charge assembly having a single liner.

In an embodiment, a plurality of explosive charge assemblies may be detonated within a wellbore. The plurality of explosive charge assemblies may be provided in one or more perforating guns, which may form at least a portion of a perforating gun string disposed within the wellbore. The plurality of explosive charge assemblies may be retained within a charge carrier within the one or more perforating guns. A detonation cord may extend through the charge carrier and be coupled to the plurality of explosive charge assemblies. Upon the initiation of the detonation in the detonator cord, the detonation may be transferred to the plurality of explosive charge assemblies and initiate a detonation in the plurality of explosive charge assemblies. One or more of the explosive charge assemblies may comprise a casing, a plurality of liners disposed within the housing, a first explosive charge disposed between the casing and a first liner of the plurality of liners, and at least a second charge disposed between adjacent pairs of the plurality of liners. The detonation may result in the formation of a jet, where each of the plurality of liners contribute to the material in the jet. The jet may have an extended length relative to a jet formed by an explosive charge assembly having only a single liner. In an embodiment, each of the plurality of explosive charge assemblies may comprise a plurality of liners and result in the formation of an jet having an extended length. The jets may penetrate the subterranean formation surrounding the wellbore to form a plurality of perforation tunnels. The perforation guns may then be removed from the wellbore. A variety of workover, completion, and/or production operations may be performed after the perforating procedure. One or more fluids (e.g., hydrocarbons, water, etc.) may then be produced from or injected into the perforation tunnels, which may form pathways into the subterranean formation.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A perforating gun assembly comprising:

a gun body;

a charge carrier frame disposed within the gun body; and a plurality of explosive charge assemblies disposed in the gun body, wherein each of the explosive charge assemblies is retained in position by the charge carrier frame, and wherein each of the explosive charge assemblies comprises:

a casing;

a plurality of liners disposed within the casing;

a plurality of explosive charge layers, wherein a first of the explosive charge layers is disposed between the casing and a first liner of the plurality of liners, and wherein at least one explosive charge layer of the plurality of explosive charge layers is disposed between adjacent liners of the plurality of liners, and wherein the plurality of liners is collapsible to provide a stream of particles that form a single, coherent jet upon detonation of the plurality of explosive charge layers; and a separate booster charge detonatable to detonate the first of the explosive charge layers.

2. The assembly of claim 1, further comprising a detonator cord coupled to the one or more explosive charge assemblies, and the booster charge is disposed between the detonator cord and the plurality of explosive charge layers.

3. The assembly of claim 1, wherein the plurality of liners are configured to form the jet having an extended length relative to an explosive charge assembly having a single liner when the plurality of explosive charge layers are detonated.

4. The assembly of claim 1, wherein at least two of the plurality of liners comprise different shapes or different compositions.

5. A method of perforating comprising:

detonating a plurality of explosive charge assemblies, wherein each of the explosive charge assemblies comprises:

a plurality of liners;

a plurality of explosive charge layers, wherein a first of the explosive charge layers is disposed between a casing and a first liner of the plurality of liners, and wherein at least one explosive charge layer of the plurality of explosive charge layers is disposed between adjacent liners of the plurality of liners; and a separate booster charge detonatable to detonate the first of the explosive charge layers;

forming a single, coherent jet from each of the explosive charge assemblies in response to the detonating, wherein the each of the plurality of liners collapse to contribute to the formation of the single, coherent jet;

engaging a surface with the jet; and forming a perforation through the surface in response to the engagement with the jet.

6. The method of claim 5, wherein the jet comprises a stream of particles.

7. The method of claim 5, wherein the jet has a length that is at least about 5% greater than a jet formed from the explosive charge assembly having only a single liner.

8. The method of claim 5, further comprising forming a perforation tunnel in a subterranean formation in response to the engagement of the jet, wherein the perforation tunnel has a length at least about 5% greater than the length of a perforation tunnel formed by a jet formed from the explosive charge assembly having only a single liner.

* * * * *